United States Patent [19]

Mitani et al.

[11] Patent Number: 4,727,726

[45] Date of Patent: Mar. 1, 1988

[54] REFRIGERATION CYCLE APPARATUS

[75] Inventors: Akio Mitani, Yokohama; Koji Kashima, Yokohama; Hiroichi Yamaguchi, Yokohama; Kouroku Endo, Tokyo, all of Japan

[73] Assignee: Kabushiki Kaisha Toshiba, Kawasaki, Japan

[21] Appl. No.: 8,329

[22] Filed: Jan. 29, 1987

[30] Foreign Application Priority Data

Oct. 31, 1986 [JP] Japan ..... 61-258507

[51] Int. Cl.[4] ..... F25B 27/02

[52] U.S. Cl. ..... 62/238.6; 62/467

[58] Field of Search ..... 62/238.6, 238.7, 467

[56] References Cited

U.S. PATENT DOCUMENTS

| | | | |
|---|---|---|---|
| 4,042,012 | 8/1977 | Perry et al. | 62/238.6 |
| 4,402,188 | 9/1983 | Skala | 62/238.6 |
| 4,482,008 | 11/1984 | Nomaguchi et al. | 62/238.6 |
| 4,487,032 | 12/1984 | Speicher | 62/238.6 |

FOREIGN PATENT DOCUMENTS 53-24182 7/1978 Japan .

60-144380 7/1985 Japan .

*Primary Examiner*—Ronald C. Capossela

*Attorney, Agent, or Firm*—Oblon, Fisher, Spivak, McClelland & Maier

[57] ABSTRACT

A refrigeration cycle apparatus includes a heat accumulating unit for accumulating an exceess heat generated during the operation of a refrigeration cycle main unit and radiating the accumulated heat at a desired time. The accumulating unit includes a heat accumulating container and latent heat accumulating material housed in the container. The material has a predetermined phase transition temperature and a supercooling state release temperature which is lower than the phase transition temperature. The material maintains a supercooling state at a temperature between the phase transition temperature and the supercooling state release temperature. When the material is cooled by a release mechanism to a temperature below the supercooling state release temperature, the supercooling state of the material is released and the material radiates the accumulated heat. The radiated heat is used for heating the refrigerant to be sent a compressor at the start of the heating or defrosting operation of the main unit.

11 Claims, 10 Drawing Figures

REFRIGERATION CYCLE APPARATUS

BACKGROUND OF THE INVENTION

This invention relates to a refrigeration cycle apparatus, and more particularly to a refrigeration cycle apparatus having a heat accumulating unit for accumulating excess heat during normal heating operation and for releasing the heat to a refrigerant path when necessary.

As is well known, a refrigeration cycle apparatus comprises a compressor, condenser, expansion valve, evaporator, etc. The apparatus can be used as either a cooler or a heater, by changing the direction in which the refrigerant flows, and is widely used.

When the apparatus is used as a heater, it requires a considerably long time until it starts generating warm air. This is because the components, such as the compressor and condenser, are cold when the apparatus is turned on. The refrigerant is also cold at this time. Naturally, the user would prefer to have the apparatus which blows out warm air as soon as it is turned on. To meet this demand, conventional apparatuses have an electric heater provided on the case of the compressor to heat the compressor. The heater is turned on when the heating operation is started. The heater therefore accelerates the heating of the refrigerant, and enables the apparatus to deliver warm air sooner. However, since the heater consumes electric power, the apparatus is disadvantageous in view of energy costs.

Recently it has been proposed that the excess heat generated during the heating operation be stored in heat-accumulating material, and later be released to heat the refrigerant whenever the apparatus is started up. This method can indeed enable the apparatus to provide warm air soon after it has been turned on, but has the following drawbacks.

It is necessary to prevent the heat from escaping the heat-accumulating material over a long period of time. To satisfy this requirement, the container for the material must be sufficiently insulated to prevent the heat from radiating outside. The use of a sufficiently insulated container increases the cost and the size of the apparatus. Due to these drawbacks, the apparatus using the heat-accumulating material is not desirable for practical use.

SUMMARY OF THE INVENTION

The present invention has been contrived in consideration of these circumstances, and is intended to provide a refrigeration cycle apparatus which is small and low in cost without losing the features of a heat accumulating type.

To achieve the above object, according to the present invention, latent heat accumulating material which maintains a stable supercooling state at a temperature below its melting point, is used as a heat accumulating material. Thus, it is possible to lessen the conditions required for the heat insulating structure of a heat accumulating container.

According to the invention, there is provided a refrigeration cycle apparatus comprising: a refrigeration cycle main unit including a compressor, a condenser, an evaporator, and refrigerant flow means for connecting the components to form a closed circuit through which a refrigerant flows; a heat accumulating unit for accumulating an excess heat generated during the operation of the main unit and for radiating the accumulated heat at a desired time to heat the refrigerant to be sent to the compressor, the accumulating unit including a heat accumulating container and latent heat accumulating material housed in the container, the heat accumulating material having a predetermined phase transition temperature, and a supercooling state release temperature which is lower than the phase transition temperature, the heat accumulating material maintaining the supercooling state at a temperature between the phase transition temperature and the supercooling state release temperature; and release means for releasing the supercooling state of the heat accumulating material to cause the heat accumulating material to radiate latent heat.

BRIEF DESCRIPTION OF THE DRAWINGS

FIGS. 1 through 2E show a refrigeration cycle apparatus according to a first embodiment of the invention, in which FIG. 1 is a plan view of the entire apparatus, and FIGS. 2A through 2E are views schematically showing the different operating modes of the above apparatus;

DETAILED DESCRIPTION OF THE PREFERRED EMBODIMENTS

Embodiments of the present invention will now be described in detail with reference to the accompanying drawings.

Figure 1:
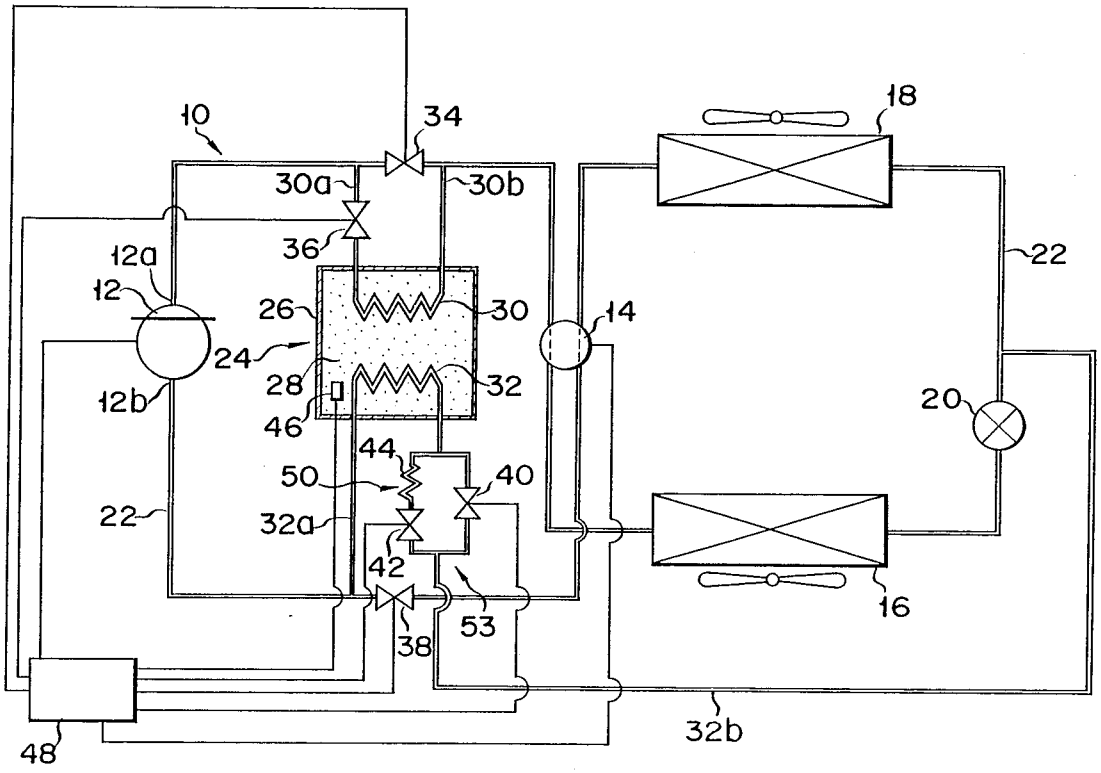

FIG. 1 shows a refrigeration cycle apparatus embodying this invention which can perform air cooling and heating operations.

The refrigeration cycle apparatus includes main unit 10. Main unit 10 comprises compressor 12, four-way valve 14, which is connected to discharge side 12*a* and suction side 12*b* of the compressor, indoor heat exchanger 16 and outdoor heat exchanger 18, which are both connected to four-way valve 14, and expansion valve 20 connected between these heat exchangers. Reference numeral 22 indicates a refrigerant pipe which connects the above components so as to form a closed circuit. The functions of heat exchangers 16 and 18 reverse as the operation of main unit 10 is shifted between cooling and heating operations. In other words, in the cooling mode, heat exchanger 16 serves as an evaporator and heat exchanger 18 serves as a condenser. In the heating mode, heat exchanger 16 serves as a condenser, and heat exchanger 18 serves as an evaporator.

The refrigeration cycle apparatus includes heat accumulating unit 24, which accumulates an excess heat generated during the operation of main unit 10 and heats the refrigerant to be sent to the suction side 12*b* of compressor 12 when it is need. Unit 24 has heat accumulating container 26, which is made, for example, of metal. In container 26 is housed latent heat accumulating material 28, which stably maintains a supercooling state when it is cooled to a temperature below the phase transition temperature Tm (melting point) thereof. Sodium acetate trihydrate, with 1 to 2% of xanthan gum added as a thickener, is used as heat accumulating material 28. The phase transition temperature (melting point) Tm of material 28 is 59° C. After this heat accumulating material is heated to a temperature above Tm and liquefied, if it is again cooled to below Tm, it does not solidify, but maintains a liquid state until it is cooled to −10° C. In other words, it remains in a supercooling state. When heat accumulating material 28 in the supercooling state is cooled to below a supercooling release temperature (−20° C.), or receives a suitable stimulus, the material is released from the supercooling state. Thus, the material solidifies immediately, and radiates the accumulated latent heat.

Heat exchangers 30 and 32 are arranged in heat accumulating container 26. One end of heat exchanger 30 is connected through refrigerant pipe 30*a*, and the other end through refrigerant pipe 30*b*, to refrigerant pipe 22 between discharge side 12*a* of compressor 12 and four-way valve 14. First solenoid valve 34 is provided in refrigerant pipe 22 between pipes 30*a* and 30*b*, and second solenoid valve 36 is provided in pipe 30*a*. Third solenoid valve 38 is provided in pipe 22 between suction side 12*b* of compressor 12 and four-way valve 14. One end of heat exchanger 32 is connected through refrigerant pipe 32*a* to refrigerant pipe 22 between solenoid valve 38 and suction side 12*b* of compressor 12. The other end of heat exchanger 32 is connected to pipe 22 between heat exchanger 18 and expansion valve 20 via refrigerant pipe 32*b*. Fourth solenoid valve 40 is provided in refrigerant pipe 32*b*. Fifth solenoid valve 42 is connected in series with capillary tube 44, which serves as a pressure reducer, and this series circuit is connected to pipe 32*b* in parallel with fourth solenoid valve 40. Solenoid valves 38 and 42, capillary tube 44, and refrigerant pipe 32*b* constitute supercooling release mechanism 53. Solenoid valve 42, capillary tube 44, and refrigerant pipe 32*b* form cooling means 50.

Temperature sensor 46, which detects the temperature of heat accumulating material 28, is provided in container 26. Sensor 46, solenoid valves 34, 36, 38, 40, and 42, compressor 12, and four-way valve 14 are electrically connected to control device 48.

The operation of the refrigeration cycle apparatus having the above construction will be described.

Figure 2A:
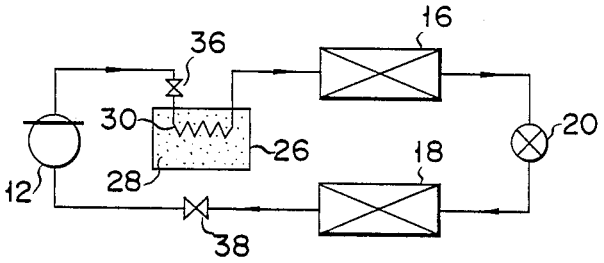
Figure 2B:
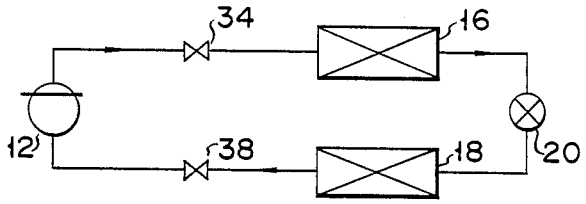

First, assume that the heating and heat accumulating operations of the apparatus have been performed. At this time, solenoid valves 36 and 38 are open, and solenoid valves 34, 40 and 42 are closed. Then, as shown in FIG. 2A, refrigerant discharged from compressor 12 flows through solenoid valve 36, heat exchanger 30, four-way valve 14, indoor heat exchanger 16, expansion valve 20, outdoor heat exchanger 18, four-way valve 14, and compressor 12 in this order. When the high temperature refrigerant discharged from compressor 12 passes through heat exchanger 30, it heats heat accumulating material 28 in heat accumulating container 26, thereby accumulating heat in the material. Then, it is condensed in heat exchanger 16 to heat the room. Thereafter, the refrigerant passes through expansion valve 20 and its pressure is reduced. When passing through heat exchanger 18, the refrigerant absorbs heat from the surrounding air and evaporates, and then returns to compressor 12. Heat accumulating material 28 is heated to a temperature above the phase transition temperature and is liquefied. With this, the heat accumulation by material 28 is completed. The temperature of material 28 is detected by sensor 46, and the detector signal is sent to control device 48. When the temperature of material 28 rises above the phase transition temperature, solenoid valve 36 is closed and solenoid valve 34 is opened by control device 48. Thus, the normal heating operation is performed. During the normal heating operation, the refrigerant, as shown in FIG. 2B, flows through compressor 12, solenoid valve 34, four-way valve 14, heat exchanger 16, expansion valve 20, heat exchanger 18, four-way valve 14, solenoid valve 38, and the compressor in this order.

Figure 2C:
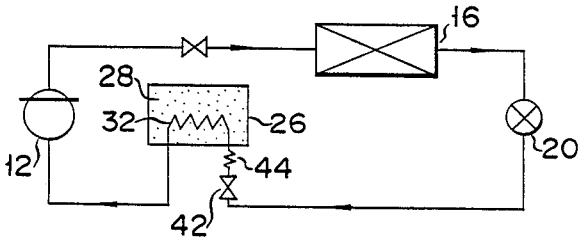
Figure 2D:
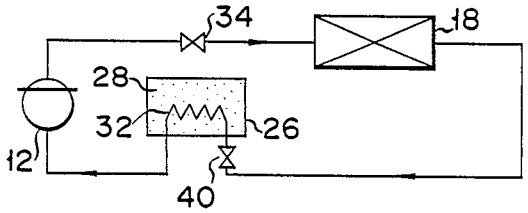

In a defrosting operation, starting from the above normal heating operation state, solenoid valve 38 is closed, and solenoid valve 42 is opened. Then, as shown in FIG. 2C, the refrigerant flows through compressor 12, solenoid valve 34, four-way valve 14, heat exchanger 16, expansion valve 20, refrigerant pipe 32*b*, solenoid valve 42, capillary tube 44, heat exchanger 32, and compressor 12 in this order. The refrigerant, cooled by passing through capillary tube 44, cools heat accumulating material 28 to below the supercooling release temperature (−20°) when it flows through heat exchanger 32. Material 28 is thus released from its supercooling state, and radiates latent heat. Its temperature rises up to the phase transition temperature. As soon as the release of supercooling state is detected by sensor 46 which detects the temperature of material 28, four-way valve 14 is switched, and solenoid valve 42 is closed and solenoid valve 40 is opened by control device 48. Then, as shown in FIG. 2D, the refrigerant flows through compressor 12, solenoid valve 34, four-way valve 14, outdoor heat exchanger 18, refrigerant pipe 32*b*, solenoid valve 40, and heat exchanger 32 in this order. The refrigerant absorbs heat from heat accumulating material 28 when it passes through heat exchanger 32, and is heated up. Consequently, the refrigerant to be sent to outdoor heat exchanger 18, i.e., a condenser, is sufficiently high in temperature and pressure, simultaneously with the start of the defrosting operation, whereby the defrosting of heat exchanger 18 is instantly performed.

The apparatus, since it uses heat accumulating material 28 as a heat source, can finish defrosting in a short time, as compared with the conventional system in which defrosting of the outdoor heat exchanger is performed by operating the refrigeration cycle main unit in the reverse cycle.

The heat load applied during defrosting operation is lower than that when the heating operation is started. By appropriately selecting the time of ending the heat accumulating and the time of starting defrosting, the temperature of the heat accumulating material can be maintained high shortly before the defrosting operation starts, thereby reducing the heat loss in the material. Therefore, only the sensible heat of material 28 can be used for defrosting, without releasing material 28 from the supercooling state.

After the defrosting operation is completed, the heat accumulating operation is performed, as shown in FIG. 2A, and then the normal heating operation is performed as shown in FIG. 2B.

Figure 2E:
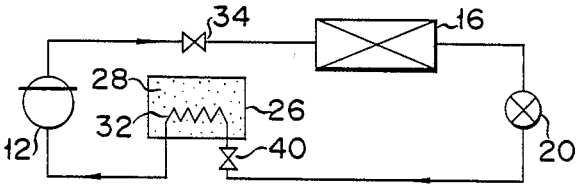

As has been described above, heat-accumulating material 28 is heated to a point above the phase transition temperature during the heating operation, and is thus in liquid state during this operation. After the refrigeration cycle apparatus has been stopped (usually at bedtime), material 28 is cooled due to the drop of the outdoor temperature during nighttime, and remains in the supercooling state until the apparatus is started again the following morning. To start the heating operation, solenoid valves 34 and 42 are opened, and solenoid valves 36, 38 and 40 are closed, by control device 48. Then, the refrigerant flow path of the refrigeration cycle apparatus is as shown in FIG. 2C, and thus the supercooling releasing operation is performed. Therefore, as in the defrosting operation, heat accumulating material 28 is cooled to a temperature below the phase transition temperature by the refrigerant which is cooled as it passes through capillary tube 44. Thus, material 28 is released from the supercooling state. As a result, material 28 radiates latent heat. Immediately after the release of the supercooling state, solenoid valve 42 is closed, and solenoid valve 40 is opened. The refrigerant bypasses capillary tube 44. The amount of circulating refrigerant, therefore, increases. As shown in FIG. 2E, the refrigerant flows through compressor 12, solenoid valve 34, four-way valve 14, heat exchanger 16, expansion valve 20, refrigerant pipe 32*b*, solenoid valve 40, heat exchanger 32 and compressor 12 in this order. The refrigerant at the suction side of compressor 12, that is, the low pressure refrigerant, when it passes through heat exchanger 32, absorbs heat from heat accumulating material 28. Thus, the refrigerant is heated and evaporated. Consequently, immediately after the start of the heating operation, compressor 12 is sufficiently heated, and the refrigerant at high temperature is sent to indoor heat exchanger 16. As a result, warm air is exhausted from heat exchanger 17, thereby heating the room. After that, each valve is shifted by control device 48, so that the heat accumulating operation and normal heating operation are performed in this order.

According to the refrigeration cycle apparatus thus constructed, at the start of the heating operation and during defrosting operation, the refrigerant in the suction side of the compressor is quickly heated by the use of the latent heat of heat accumulating material 28, thereby heating the components of the apparatus such as a compressor. As a result, the period the heating operation, from the start of the heating operation till the venting of warm air, can be greatly shortened, and defrosting can also be performed in a short time. Accordingly, efficient heating and defrosting operations can be performed.

As a heat accumulating material, the latent heat accumulating material is used, which maintains a stable supercooling state at a temperature below the phase transition temperature. Thus, even when the apparatus is stopped, the heat accumulating material does not significantly radiate any heat. Therefore, there is scarcely any need for insulating the container filled with the heat accumulating material from the outdoor air. The structure for insulating the heat accumulating container can be omitted, or the insulating conditions can be lessened. As a result, it is possible to make the apparatus small and low in cost, without damaging the advantages of the heat accumulating type apparatus. Further, the heat accumulating material remains in a stable supercooling state, and is not released from the supercooling state by the vibrations of the compressor, fans or the like during the operation of the apparatus. The latent heat is not released from material 28, and can be used whenever necessary.

Further, the low-pressure side refrigerant of the refrigerating cycle is used as the means for releasing the supercooling state of the heat accumulating material, thereby releasing the supercooling state by using a thermal stimulus. This allows a simple construction for the release means. It is better to apply a thermal stimulation to the heat-accumulating material than to apply a mechanical or electrical stimulation to the material, in order to release the material from the supercooling state. This is because heat far less affects the material than a mechanical and electrical stimulation. Hence, a thermal stimulation is applied to the material for this purpose, and the quality of the material remains unchanged over a long period of time.

Figure 3:
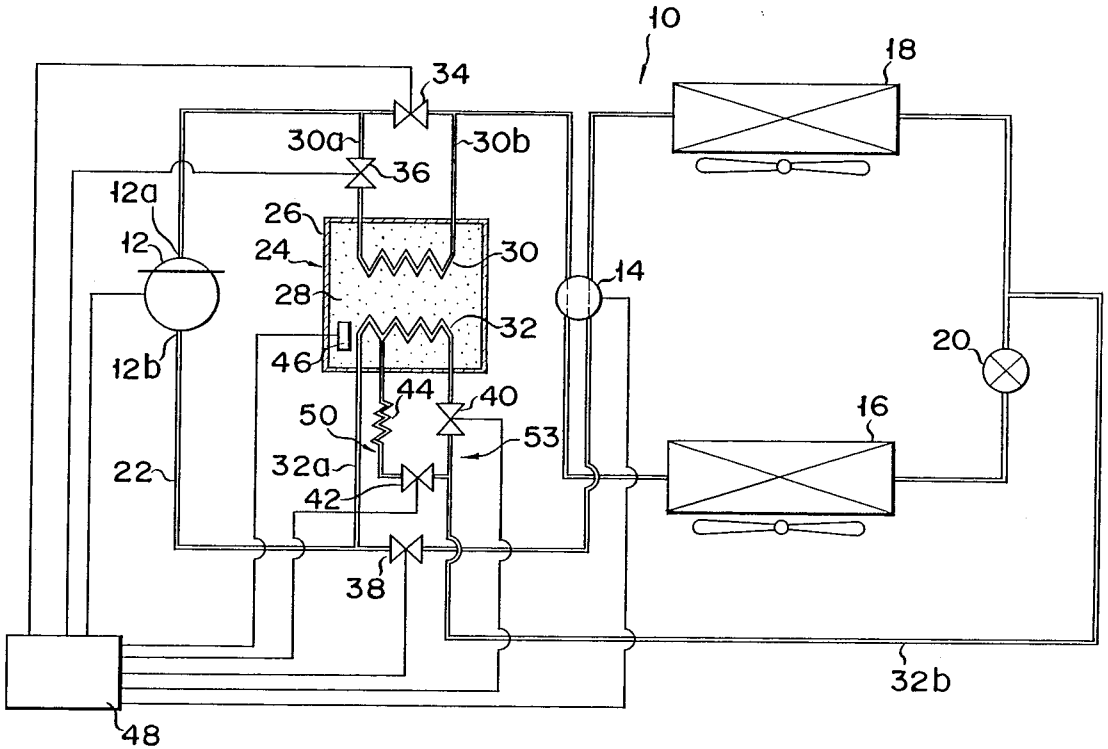
FIG. 3 is a plan view of a refrigeration cycle apparatus according to a second embodiment of the invention.

FIG. 3 shows a refrigeration cycle apparatus according to a second embodiment of the invention. The same portions as those in FIG. 1 are designated by the same reference numerals, and the detailed description thereof is thus omitted.

The difference of the second embodiment from the first embodiment is that the supercooling state of the heat accumulating material is released by locally cooling the same. Specifically, in this embodiment, refrigerant pipe 32*b* has a branch path 32*c* which is connected to a middle-portion of heat exchanger 32. Capillary tube 44 and solenoid valve 42 are arranged in the branch path. The refrigerant cooled as it passes through capillary tube 44, locally cools heat accumulating material 28.

With the above apparatus, to release material 28 from the supercooling state, a portion of the material is first cooled to below the release temperature (−20° C.) and thus released from the supercooling state. Then, the temperature fall proceeds in the remaining portion of material 28, gradually from said portion. This method cools the entire material 28 to below −20° C. faster than by cooling the entire material from the beginning. Hence, material 28 can be released from the supercooling state in a short time.

As described above, in the second embodiment, the same advantages as those in the first embodiment can be obtained. Further, the time it takes to reach the heating state can be much shorter, and the defrosting can be performed much faster.

Figure 4:
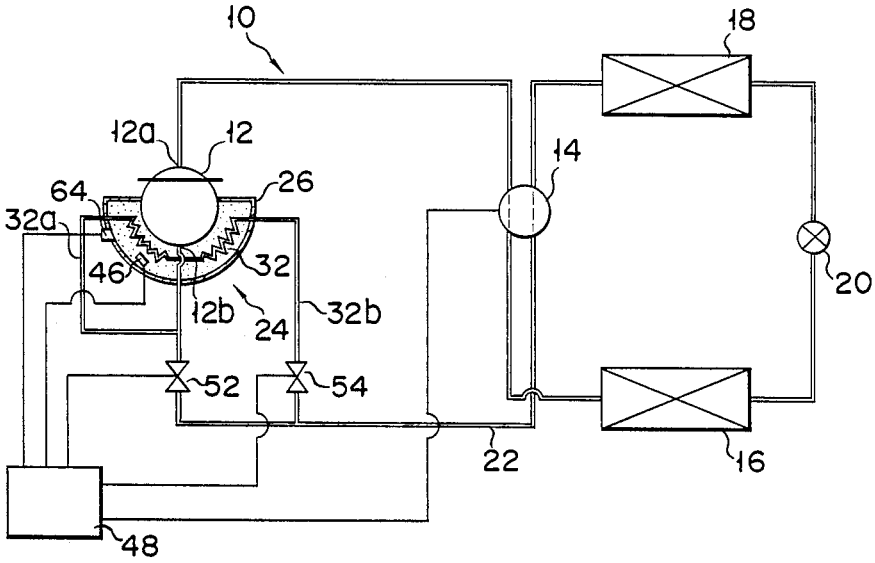
FIGS. 4 and 5 are a plan view and a cross-sectional view showing a refrigeration cycle apparatus according to a third embodiment of the invention.
Figure 5:
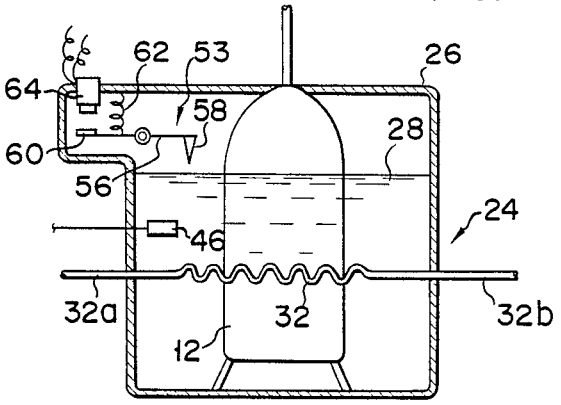

FIGS. 4 and 5 show a third embodiment of the invention. In this embodiment, heat accumulating container 26 is attached to the case of compressor 12 at suction side 12*b* thereof. Heat accumulating material 28 housed in container 26 is in contact with the outer surface of the case. Refrigerant pipe 22 is provided with solenoid valve 52 at suction side 12*b* of compressor 12. Heat exchanger 32 is arranged in container 26 and in contact with heat accumulating material 28. One end of heat exchanger 32 is connected to refrigerant pipe 22 between suction side 12*b* of compressor 12 and solenoid valve 52 via refrigerant pipe 32*a*. The other end of heat exchanger 32 is connected to refrigerant pipe 22 between four-way valve 14 and solenoid valve 52 via refrigerant pipe 32*b*. Pipe 32*b* is provided with solenoid valve 54.

Supercooling state release mechanism 53 employs a mechanism which releases the supercooling state of the heat accumulating material by using shearing stress. More specifically, release means 53 includes lever 56 located in heat accumulating container 26. The halfway portion of the lever is rotatably supported. At one end of lever 56 is mounted needle 58 which can enter heat accumulating material 28. Iron piece 60 is mounted on the other end of lever 56. Lever 56 is urged by spring 62 in such a direction as to cause needle 58 to be apart from heat accumulating material 28. Electromagnet 64 is fixed to container 26, facing iron piece 60. Electromagnet 64 is connected to control device 48, and is energized by the control device if necessary. When electromagnet 64 is energized, it attracts iron piece 60 to rotate lever 56, thereby introducing needle 58 into heat accumulating material 28.

The remaining configuration is the same as that of the first embodiment except for the portions described above, and no further description will be given.

In the third embodiment, at the start of the heating operation, electromagnet 64 is energized by control means 48. Then needle 58 enters heat accumulating material 28 and mechanically stimulates the heat accumulating material, thereby releasing the supercooling state of the heat accumulating material. Thus, the heat accumulating material radiates latent heat. At the same time, control device 48 closes solenoid valve 52 and opens solenoid valve 54. The refrigerant discharged from compressor 12 flows through four-way valve 14, indoor heat exchanger 16, outdoor heat exchanger 18, four-way valve 14, solenoid valve 54, refrigerant pipe 32*b*, heat exchanger 32, and the compressor in this order. When passing through heat exchanger 32, the refrigerant absorbs heat from heat accumulating material 28. Thus, it is heated and evaporated. In the same manner as in the first embodiment, therefore, warm air can be radiated from heat exchanger 16 immediately after the start of the heating operation.

When defrosting is performed during the heating operation, solenoid valves 52 and 54 are switched in the same manner as described above and supercooling state release mechanism 53 is operated. In addition, four-way valve 14 is switched. As a result, the defrosting of outdoor heat exchanger 18 can be performed in a short time.

It is understood that the present invention is not limited to the above mentioned embodiments and that various changes and modifications may be applied therein without departing from the scope of the invention.

Figure 6:
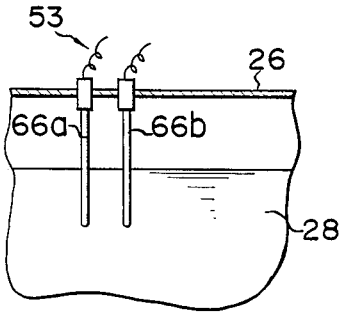
FIG. 6 is a cross-sectional view schematically illustrating a modification of a supercooling state release means.

For example, the heat accumulating material is not limited to sodium acetate trihydrate but may be any latent heat accumulating material if it maintains a stable supercooling state at a temperatures below the phase transition temperature. The supercooling state release mechanism is not limited to those in the above embodiments, but may be the one which uses electric stimulus as shown in FIG. 6. In the modification shown in FIG. 6, a release mechanism includes a pair of electrodes 66*a* and 66*b* located in heat accumulating material 28. By flowing electricity through these electrodes, heat accumulating material 28 is stimulated. Thus, the supercooling state is released.

What is claimed is:

1. A refrigeration cycle apparatus comprising:

a refrigeration cycle main unit including a compressor, a condenser, an evaporator, and refrigerant flow means for connecting the above components to form a closed circuit through which a refrigerant flows;

a heat accumulating unit for accumulating an excess heat generated during the operation of said main unit and for radiating the accumulated heat at a desired time to heat the refrigerant to be sent to the compressor, said accumulating unit including a heat accumulating container and latent heat accumulating material accommodated in the container, said heat accumulating material having a predetermined phase transition temperature, and a supercooling state release temperature which is lower than the phase transition temperature, said heat accumulating material maintaining a supercooling state at a temperature between said phase transition temperature and said supercooling state release temperature; and release means for releasing the supercooling state of the heat accumulating material to cause the heat accumulating material to radiate latent heat.

2. A refrigeration cycle apparatus according to claim 1, wherein said release means includes cooling means for cooling the heat accumulating material to a temperature below the supercooling state release temperature.

3. A refrigeration cycle apparatus according to claim 2, wherein said cooling means includes passage means for guiding the refrigerant which passes through the condenser to the heat accumulating material and a decompressor provided in the passage means for cooling the refrigerant.

4. A refrigeration cycle apparatus according to claim 3, wherein said release means includes a heat exchanger provided in the heat accumulating container, and having one end connected to the passage means and the other end connected to the suction side of the compressor.

5. A refrigeration cycle apparatus according to claim 4, wherein said release means includes a first valve for controlling the refrigerant flow into the passage means, a second valve arranged in the passage means in series with the decompressor, for controlling the refrigerant flow into the decompressor, and a third valve connected to the passage means in parallel with the decompressor and second valve, for introducing the refrigerant into the heat exchanger, bypassing the decompressor.

6. A refrigeration cycle apparatus according to claim 4, wherein said passage means includes a branch path connected to an end portion on the discharge side of the heat exchanger, and said decompressor is provided in the branch path.

7. A refrigeration cycle apparatus according to claim 1, wherein said heat accumulating unit includes a heat exchanger for heat accumulation provided in the heat accumulating material and connected to the discharge side of the compressor, and valve means for controlling the refrigerant flow into the heat exchanger.

8. A refrigeration cycle apparatus according to claim 1, wherein said heat accumulating container is provided adjacent to the compressor, and said heat accumulating material is housed in the container while being in contact with the compressor.

9. A refrigeration cycle apparatus according to claim 1, wherein said heat accumulating material is a mixture of sodium acetate hydrate and thickener.

10. A refrigeration cycle apparatus according to claim 1, wherein said release means includes stimulating means for applying shearing force to the heat accumulating material to release the supercooling state of the heat accumulating material.

11. A refrigeration cycle apparatus according to claim 1, wherein said release means includes stimulating means for applying electrical stimulus to the heat accumulating material to release the supercooling state of the heat accumulating material.

* * * * *